United States Patent [19]

Hellstrom

[11] Patent Number: 4,619,182

[45] Date of Patent: Oct. 28, 1986

[54] ARRANGEMENT FOR DEFLECTING POWDER GASES FROM AN AIRCRAFT WEAPON

[75] Inventor: Gunnar Hellstrom, Linköping, Sweden

[73] Assignee: Saab-Scania Aktiebolag, Linköping, Sweden

[21] Appl. No.: 574,057

[22] Filed: Jan. 26, 1984

[30] Foreign Application Priority Data

Jan. 31, 1983 [SE] Sweden ..... 8300464

[51] Int. Cl.[4] ..... F41D 11/24

[52] U.S. Cl. ..... 89/37.16; 89/14.3

[58] Field of Search ..... 89/37.16, 14.3

[56] References Cited

U.S. PATENT DOCUMENTS

| | | | |
|---|---|---|---|
| 1,555,026 | 9/1925 | Rose | 89/14.3 |
| 1,801,258 | 4/1931 | Barker | 89/14.3 |
| 2,567,826 | 9/1951 | Prache | 89/14.3 |
| 2,787,194 | 4/1957 | Peterson | 89/14.3 |
| 2,899,866 | 8/1959 | Clark et al. | 89/37.16 |
| 3,099,938 | 8/1963 | Marshall et al. | 89/14.3 |

*Primary Examiner*—Deborah L. Kyle
*Assistant Examiner*—John S. Maples
*Attorney, Agent, or Firm*—James E. Nilles; James R. Custin

[57] ABSTRACT

Powder gases issuing from the muzzle of an aircraft-mounted gun are initially deflected to one side of the line of fire by a mouthpiece in the form of a length of pipe coaxially mounted directly in front of the muzzle and having an elliptical mouth extending all across it and along it from a pointy front end of it to a short distance in front of its rear end. The gases are further deflected to a discharge direction away from sensitive parts of the aircraft by a set of guide plates arranged outside the mouthpiece and spaced apart at regular intervals along the line of fire. Inner surface portions of the guide plates, proximal to the extended axis of the gun barrel, are parallel to the direction of local gas flow out of the mouthpiece, and the guide plates are curved so that their outer surface portions, which cooperate to define slot outlets, extend in said discharge direction and are parallel to one another.

6 Claims, 4 Drawing Figures

ARRANGEMENT FOR DEFLECTING POWDER GASES FROM AN AIRCRAFT WEAPON

The present invention relates to means for deflecting powder gases from an aircraft weapon such as an automatic cannon that is built into the structure of an aircraft; and the invention is more particularly concerned with deflector means whereby such gases are caused to be directed, in their entirety, in a direction away from the aircraft.

It is known that powder gases from an aircraft carried automatic cannon or similar gun create a number of difficult problems. The gases have a high pressure and high temperature and therefore, upon flowing out of the gun muzzle, they can occasion unacceptable stresses upon the surrounding aircraft structure, especially if the weapon is completely built into that structure. The gases are strongly corrosive, and the surfaces that they touch acquire a carbon deposit that cannot be tolerated, especially if optical apparatus is mounted in the structure.

An undesirable consequence of firing a gun is the shock wave that is produced by reason of the high velocity of the outflowing gases. For every fired projectile there arises a first shock wave, produced by the air that is in the gun barrel in front of the projectile and which issues from the barrel, and a second shock wave which is substantially more powerful than the first and is produced by the powder gases. Both propagate from the gun muzzle in the same direction as the respective gas flows, in a course of events that is surveyed in AIAA paper No. 74 - 531 among others. If nothing is done about it, there is thus developed a pressure that pulses at the shot frequency, the distribution of which depends wholly upon the gas flow, and which therefore can be damaging to the equipment on the aircraft that lies in the path of the shock wave.

However, the most serious problem in connection with an automatic cannon installation in an aircraft is the risk of powder gases causing disturbances of engine operation. This problem has been known to aviation technology, and solutions have been sought for it since the advent of jet engines; and it is especially urgent in cases where for reasons connected with functioning of the gun itself or for structural reasons, a gun must be mounted with its barrel mouth near a jet engine air intake. There are then certain critical flight conditions in which a greater or lesser portion of the powder gas flow can reach the intake and can cause serious disturbances to engine operation, or even cause stopping of the engine. If the gun installation cannot be changed, restrictions must then be imposed upon flight operations, such that the gun will not be fired under the critical flight conditions.

Such a situation is illustrated in FIG. 1 of the accompanying drawings, which is based upon a photograph taken during a wind tunnel test. For this there was employed a wind tunnel model of a fighter airplane 1 with an air intake 2 at the side of the fuselage. In a space between the fuselage and the intake an automatic cannon is assumed to be so mounted that the powder gas flow 3 from the "cannon", as the figure shows, is directed obliquely forwardly - downwardly from the underside of the fuselage. The gas flow forms a small cloud which quickly broadens out markedly, and as a result, in the illustrated flight condition in which the angle of attack is 20°, a substantial mass of gas 4 from the upper portion of the cloud reaches the air intake 2, through which it is sucked into the engine. With such an installation of the gun it would certainly be necessary to limit the conditions of use to exclude a flight condition like that illustrated. It will be apparent that a pilot who found himself in such a condition in actual air combat would not willingly observe such a limitation and refrain from using the gun. Instead the probability is that, in order to avoid being shot down, he would take the risk of an engine disturbance, so that in consequence of the unsuitable gun installation he would expose himself and the aircraft to great danger.

Swedish Pat. No. 161,668 discloses an arrangement which comprises a pressure equalizing chamber that is divided into a number of compartments which are located one behind the other in the shooting direction. The chamber has an outlet that discharges gases upward or downward, so that they flow out in a direction that is tangential in relation to the aircraft skin that extends alongside the cannon barrel. The arrangement prevents powder gases from penetrating into an engine air intake located behind it. Apart from the fact that this construction is undesirable because the outlet parts of the pressure equalizing chamber are required to lie outside the aircraft skin, it has the weakness that the deflected powder gases are caused to follow the aircraft structure, so that the arrangement does not solve the problem, but instead preserves the problem in a different form by allowing powder gases to give rise to different stresses and influences upon the structure, as pointed out above. Furthermore, only a part of the powder gas flow is deflected, while a remaining portion of it can flow out of the farthest forward chamber in the shooting direction through the opening for projectiles. If a modern fighter aircraft were provided with an air intake and cannon arranged in accordance with FIG. 1, such a large gas flow would be given off in the shooting direction, and there would consequently be such a great likelihood of its penetrating through the air intake to the engine, that the engine would certainly be disturbed.

Many other constructions have been brought forward for this purpose. An example is the so-called shot groove which, as the name implies, provides a long, narrow channel along which the projectiles pass and which is open outward from the adjacent structure, usually all the way from the muzzle forward to the location where the structure curves away from the shooting direction. Even if such a shot groove can achieve a deflection of powder gases that is acceptable for certain applications, its effect from an aerodynamic standpoint is wholly insufficient for it to be capable of use with good results in combination with an automatic cannon and a nearby air intake, as for example accordihg to FIG. 1, to thereby eliminate the risk of engine disturbances.

The present invention, the objective of which is to solve the above stated problem, thus has for its general object to provide a deflection arrangement which is able to effectively guide the powder gases given off from an aircraft-carried gun away from the nearby aircraft structure.

It is also an object of the invention to provide a solution that is optimal, not only in eliminating the problem of engine disturbances but also in minimizing the damaging influences upon the aircraft's skin and equipment that powder gases and the shock waves intimately associated with them have had in heretofore available gun installations.

An important desideratum for solving the problem of engine disturbance is that the deflecting arrangement shall so influence the flow field in which the powder gas flow appears that it remains very cohesive and obtains a main flow direction which strongly diverges from the shooting direction. The angle between those two directions should preferably be significantly larger than the angle of attack that exists at the instant of shooting. A closely related requirement is that none of, or only a negligible part of, the powder gas stream should be allowed to be given off forwardly in the shooting direction.

This objective is met by the present invention, which is primarily characterized by a mouthpiece arranged directly in front of the cannon muzzle, through which the gas stream from the cannon muzzle flows and which has the form of a pipe cut off all across it at an acute angle, to form a long, narrow elliptical opening which faces outward from the aircraft's structure and which initially deflects the gas flow in a direction that diverges obliquely forwardly - outwardly from the shooting direction, and a set of guide plates which are arranged one behind the other in the shooting direction in the space in front of and outside the mouthpiece, which engage the initially deflected gas flow and are so formed and directed that the gas flow is further deflected by them and is caused to be discharged in a direction mainly outward from the aircraft structure.

An inconvenience not previously mentioned herein but well known, arising in all firing of guns fixed in an aircraft, is the recoil force. It is especially troublesome with automatic cannon of heavy caliber because it can result in unacceptably large forces upon the structure. It is therefore an objective of this invention to reduce this effect, and in this respect the invention offers a simple but very effective solution in that the deflection arrangement provides a reduction of the recoil force to such extent as is desired for the particular construction situation. This solution is characterized according to the invention in that the mouthpiece and at least one part of the guide plate set are non-displaceably coupled to the cannon barrel.

The invention is more fully explained below with reference to the accompanying drawings, which illustrate what is now regarded as a preferred embodiment of the invention and wherein.

Figure 1:
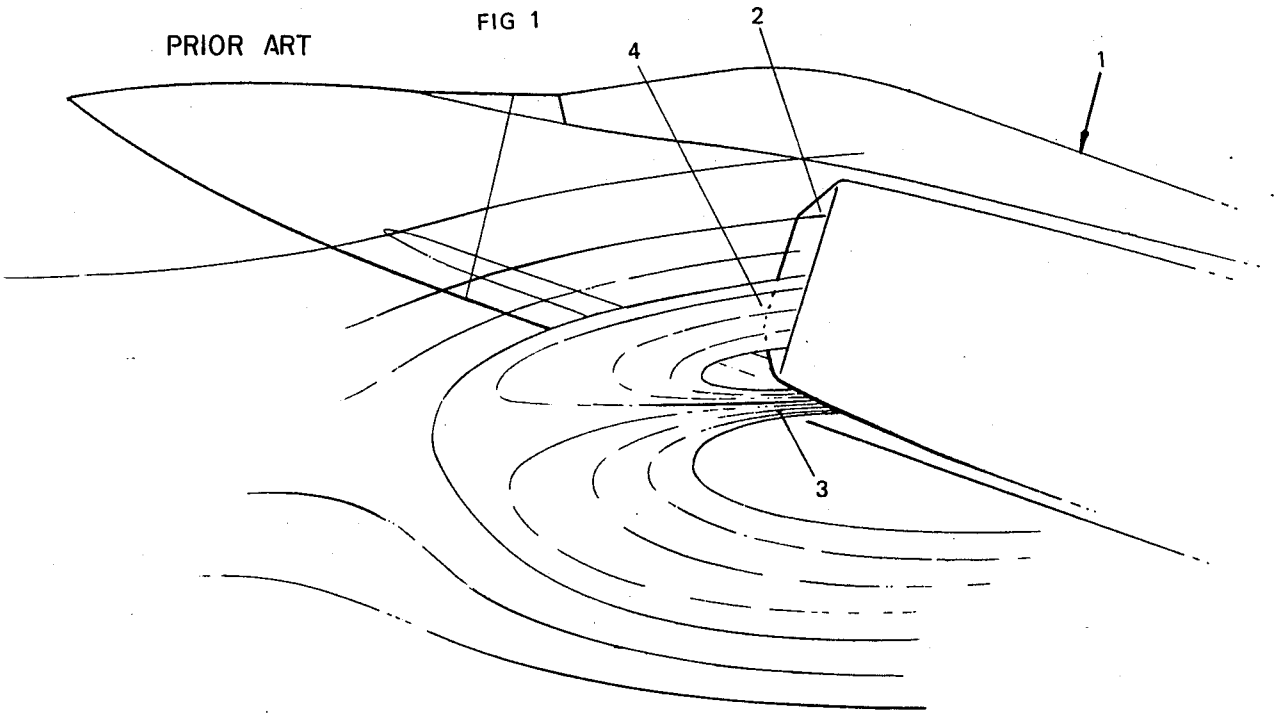
FIG 1 PRIOR ART
FIG. 1 is the above-discussed side view of a prior art installation.
Figure 2:
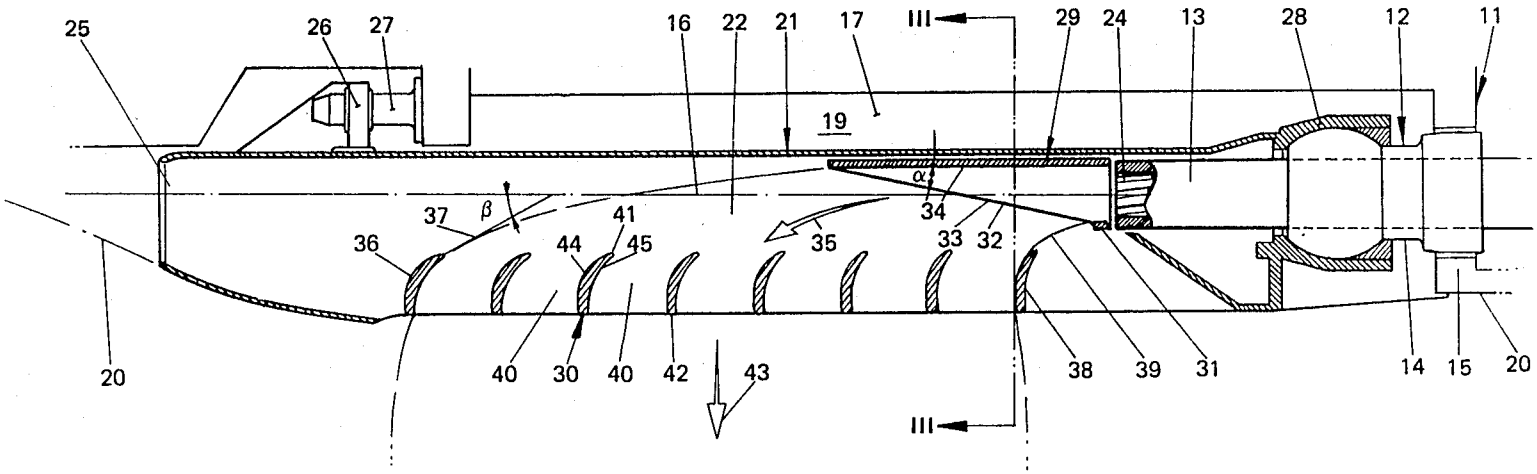
FIG. 2 is a view in section of an arrangement according to the invention, on a plane coinciding with the shooting direction.
Figure 3:
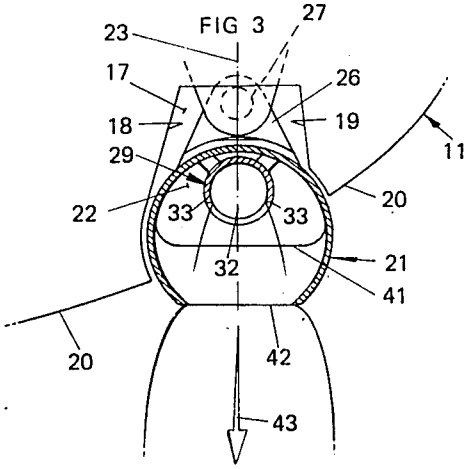
FIG. 3 is a view in cross-section taken on the plane of the line III—III in FIG. 2.

In FIGS. 2 and 3, 11 designates generally an aircraft structure that can be an outer part of an aircraft fuselage side or belly, or alternatively a part of the wing or a nacelle on it. In the vicinity of an air intake (not shown) that leads to the aircraft engine installation there is built into the structure an automatic cannon or similar gun 12, of which only the front part of its barrel 13 is shown in FIG. 2. By means of a surrounding bushing 14 and a guide fitted to it in a fixed transverse wall 15, the barrel 13 is confined radially but is movable in the shooting direction 16 relative to the structure.

In front of the wall 15 the aircraft structure forms a groove-shaped chamber 17 that extends in the shooting direction, which chamber is open at its front and is bounded by parallel side walls 18, 19, as schematically shown in FIG. 3. Between them the side walls form a longitudinal opening which, in the example, faces obliquely downward from the surrounding aircraft skin 20. In this opening is inserted an arrangement according to the invention for deflection of powder gases from the gun.

The gas deflecting means comprises, in the embodiment illustrated in the drawing, a duct-shaped housing 21 which extends lengthwise through the groove-like chamber 17 and defines in it a substantially cylindrical space 22 which extends along the plane of symmetry 23 (FIG. 3) of the arrangement, from the mouth 24 of the barrel forward to a shot opening 25, and which provides a free passage for projectiles from the gun. The housing 21 is forwardly supported by means of a bracket 26 through which extends a dowel pin 27 that comprises a part of the fixed structure and is located in the plane of symmetry, on which the bracket and the housing can move axially. A similar dowel pin (not shown) at another location prevents rotation of the housing.

The rear portion of the housing 21 is connected with the gun barrel 13 by means of a rearwardly projecting bearing ring 28 which, when the arrangement is assembled, surrounds like a bowl a spherical enlargement of the barrel bushing 14. The housing 21 is thereby axially fixed relative to the gun barrel but can guide itself somewhat around the bearing's spherical center, which facilitates assembly.

The deflection arrangement of the invention comprises a mouthpiece 29 that is seated in the housing 21 directly in front of the muzzle 24, and a set of guide plates 30 which are arranged one after another in the shooting direction in the part of the cylindrical space 22 that is located ahead of and outside the mouthpiece 29.

The mouthpiece has the form of a pipe which has an inside diameter somewhat larger than the caliber of the gun so that it can receive powder gases from the muzzle and which is cut off across its full width at an acute angle to its axis. The pipe has its full periphery only at its rear end 31, from which there extends the acute angle cutoff, which defines a long, narrow elliptical opening 32 that is bounded by edges 33 and faces in the direction of the plane of symmetry 23 of the housing 21, that is, generally outward from the aircraft skin 21. The cutting plane that defines the elliptical opening, which must be at right angles to the symmetry plane 23, forms with the inside surface 34 of the pipe a tip angle $\alpha$, the magnitude of which should be matched to the powder gas pressure and which should be kept as small as possible inasmuch as it is advantageous from an aerodynamic standpoint if the length of the opening 32 is large in relation to its breadth. On practical grounds, however, the length of the mouthpiece should be limited by selecting a tip angle $\alpha$ of 10° or more, but preferably not over 20°. As is explained below, the mouthpiece gives rise to an initial deflection of the powder gas stream, so that upon issuing from the opening 32 the gas stream has a main direction which, at the middle of the flow field, is approximately as shown by the arrow 35.

The guide plate set 30 should be so arranged in the flow field in front of the mouthpiece 29 that no part of the gas flow from the mouthpiece remains uninfluenced by the guide plates. The position of the most forward guide plate 36 should thus be matched to the front emission boundary 37 of the flow field, while the guide plate 38 at the opposite end of the set has its position determined in an analogous manner by the rear emission boundary 39. The guide plates between the front and rear ones should preferably be equally spaced along the length of the housing 21, and the distances between them should not be greater in relation to the height of the guide plates than would give the guide plate system the character of a slot outlet 40. In the height direction the guide plates are bounded by inner and outer edges 41 and 42, respectively, which extend from side to side of the housing 21 at right angles to the plane of symmetry 23. The guide plates can thus be appropriately formed in one piece with the housing 21, in FIG. 3.

The arrow 43 shows the free main stream direction that is obtained as a consequence of the further deflection of the gas flow by the guide plate system.

In addition to the form of the mouthpiece 29, the configuration of the guide plates 30 is of great significance to the functioning of the deflection arrangement. For best results, the inner edge portions of the guide plates are matched to the gas flow upstream from the guide plates; that is, on every guide plate the portions of its opposite surfaces 44, 45 which are adjacent to its inner edge 41, and which are engaged by the gas stream issuing from the mouthpiece, extend parallel to the local stream direction. Thus the upstream portions of the surfaces 44, 45 form an angle $\beta$ with the shooting direction 16 which varies within the set of guide plates, preferably from guide plate to guide plate, so that the angle progressively diminishes, from the guide plate 38 that is farthest back to the guide plate 36 that is farthest forward.

However, the direction of downstream portions of the surfaces 44, 45, which are adjacent to the outer edges 42 of the guide plates, does not vary; but instead it is important to the deflecting function that these downstream surface portions, and hence all of the outlet slots 40 that they define, have a uniform direction. In the illustrated embodiment, therefore, all of the guide plate surfaces adjacent to the outlet edges 42 are approximately parallel, forming in the main a right angle with the shooting direction and with the longitudinal downwardly turned opening of the housing 21 that contains the outlet edges. It will be understood that the opening is sufficiently wide (as measured transversely to the plane of symmetry 23) so that the side parts of the flow field in the slot outlet will not be large. Alternatively, therefore, the cross-section of the housing can deviate from circular form and can have a form matched to the gas flow, with less difference in length between the inner edge 41 and the outer edge 42 of each guide plate.

In the illustrated example the plane of symmetry 23 is vertical and forms, as FIG. 3 shows, an oblique angle with the most nearly adjacent skin surface 20. However, it would not matter if the whole deflecting arrangement were rotated about the extended muzzle axis 16 through an arbitrary angle, so that the plane of symmetry 23 and the gas flow from the arrangement takes some other position that is optimal with regard to the engine air intake or some other critical part of the aircraft that should be protected from powder gases.

Figure 4:
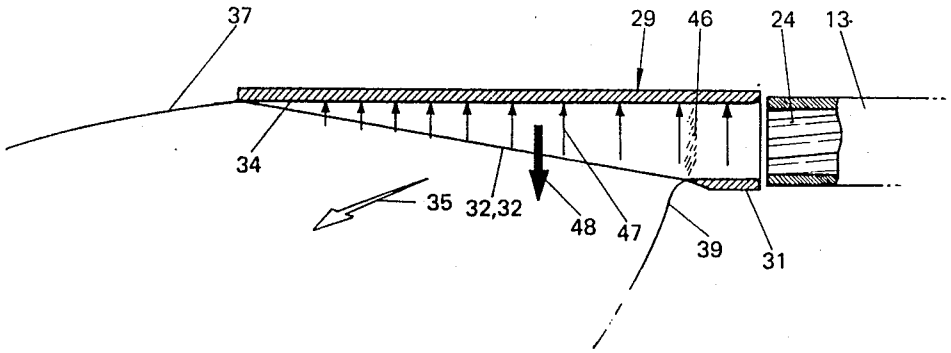
FIG. 4 is a diagrammatic view in longitudinal section showing the aerodynamic forces and flow directions produced with the mouthpiece that the arrangement comprises.

For an explanation of the function of the deflection arrangement reference is now made to FIG. 4 which shows, enlarged, the mouthpiece 29 and the muzzle 24. Through these, every time a projectile is shot, there rushes a gas flow that has a very high pressure, inasmuch as an automatic cannon or similar gun is here being considered.

The pressure is sufficiently high for the gas to attain sonic velocity when it leaves the barrel 13 and flows through the closed mouthpiece part 31 into the zone, designated by 46 in the figure, where the elliptical mouthpiece opening 32 begins. Outside the mouthpiece opening there will occur a supersonic expansion over the whole of the gas flow, which, in the figure, is symbolically bounded by the emission boundaries 37 and 39.

Such an expansion does not occur in the inside of the mouthpiece 29, however; but instead an overpressure builds up here, acting over the whole wall of the mouthpiece, as is illustrated by the arrows 47. The reaction to that overpressure is a force upon the powder gases that is directed in the opposite direction, outward from the wall, and is illustrated by the arrow 48; and it is this effect from inside that causes the expanding gas flow to be deflected obliquely forwardly-outwardly in leaving the mouthpiece. This initial deflection can vary to a certain extent, depending upon the tip angle $\alpha$ and the powder gas pressure. Specifically, a long pointy mouthpiece, combined with a high gas pressure, gives a better effect—including a somewhat greater deflection angle relative to the natural directly forward outflow direction—than a short and more blunt mouthpiece, which would be chosen if the gas pressure is lower. The better effect of the long, pointy mouthpiece also includes its producing a gas emission with relatively little width but large axial extent, which is advantageous for the total operation of the arrangement. With the form of mouthpiece shown in the drawing, the powder gases from an automatic cannon, at the center of the flow field, are deflected about 25°, and the emission is very cohesive and little broader than the opening 32, as shown in FIG. 3.

Notwithstanding its being deflected to some extent, such a powder gas flow with free discharge would be harmful in many cases, as for example where a weapon is installed near an air intake; and therefore the whole, or nearly the whole, of the initially deflected gas flow from the mouthpiece 29 is further deflected by the guide plate system 30. When the flow meets the inner edges 41 of the guide plates it has a divergent stream direction, with the angle $\beta$ progressively diminishing forwardly. But because the portions of the surfaces 44, 45 of the guide plates that are near their inner edges 41 are inclined in correspondence with the local value of the angle $\beta$, the gas flow meets every guide plate tangentially, and there develops in the slots between the guide plates a nearly undisturbed stream and an evenly divided flow that takes the same direction as the slot outlet 40.

The direction 43 of the gas stream issuing from the guide plates thus depends upon how much they are curved, that is, at what angle their surface portions adjacent to their outlet edges 42 are directed, it being understood that all of those surface portions ought to be parallel. The outlet angle is not limited to a maximum value of 90° to the shooting direction, the value shown in the drawing, but, if necessary, the curvature of the guide plates can be greater, to attain, for example, a total deflection angle of 120°; and equally well, with a somewhat shallower forwardly directed guide plate profile, a less strongly deflected powder gas flow can be obtained at an angle, for example, of 60° relative to the shooting direction. It may here be pointed out that the powder gases which now flow out into the open still have a very high pressure, so that the flow is very cohesive and retains its rectangular cross-section relatively far away from the aircraft structure. The powder gas stream therefore will not enter an air intake located at the side of the gun.

The deflection arrangement according to the invention also has a positive influence upon the shock wave in the powder gas flow. That unavoidable phenomenon, as already mentioned, has occasioned concern for aviation technicians, especially in the case where a weapon discharges powder gases directly into the open, because the shock wave, as is known, has a spherical propagation. Heretofore attempts have been made to reduce the energy in the gas flow by inserting a shock wave damper in the open in front of the outlet, intended to cooperate with the deflecting means in progressively dampening the shock wave; but this breaks apart the stream and therefore causes an ineffective deflection. Instead, with the arrangement of the present invention there is achieved a limiting of the shock wave's propagation in the critical direction which is here of course assumed to coincide with the direction transverse to the mouthpiece 29. Because the shock wave and the gas flow accompany one another and have the same propagation, it is possible, by holding down the width of the mouthpiece and thereby the width of the gas flow, to protect the delicate parts of the aircraft from stress from shock waves, even though the outflowing powder gases have high energy.

The deflection arrangement also favorably influences the recoil of the gun. If the arrangement is embodied, as in the illustrated example, so that it is in its entirety mechanically coupled to the gun 13 and can follow along with its movement, the recoil force of the strongly deflected and energy rich gas emission is greatly reduced. The magnitude of the recoil force is directly dependent upon how large the total deflection angle is, as measured from the shooting direction. It will be seen that the deflection means allows the aircraft structure to take up a transverse force which, in the example in FIG. 2, is directed straight upward. By connecting only parts of the arrangement to the weapon, for example solely the mouthpiece 29 and/or a certain part of the housing 21 and the guide plate system 30, while the remaining part is fixedly mounted in the aircraft structure, the magnitude of the recoil force and the transverse force can be varied and optimized for the particular installation.

What is claimed as the invention is:

1. Gas deflector means whereby powder gases issuing forwardly from the barrel of an aircraft-carried gun are deflected to one side of the forwardly extended axis of said barrel and to a discharging direction away from parts of the aircraft that would be adversely affected by such gases, said gas deflector means comprising:

A. a housing;

B. a mouthpiece forwardly adjacent to the gun barrel for initially deflecting powder gases towards said one side of said extended axis, in the form of a length of straight pipe concentric to said axis and having an inside diameter at least as large as that of the gun barrel, said mouthpiece having an outlet that opens obliquely forwardly and toward said one side of said axis, defined by an edge thereon which (1) is contained in a plane disposed at an acute angle to said extended axis and (2) extends along the mouthpiece from a point that is near the rear end thereof but spaced forwardly therefrom and at said one side of said axis to a point that is at the diametrically opposite side of said axis and at a substantially pointed front end of the mouthpiece; and C. a plurality of guide plates mounted on the housing at the exterior of said mouthpiece, for further deflecting said gases to said discharging direction, (1) each said guide plate having substantially opposite inner and outer edges that extend substantially transversely to said extended axis, said inner edge of each guide plate being proximal to said extended axis, (2) said guide plates (a) having their inner edges spaced to said side of said extended axis at substantially uniform distances therefrom and (b) being spaced apart in the direction along said axis at substantially uniform distances to cooperate in defining gas outlet slots, and (3) each guide plate being so curved between its inner and outer edges as to have (a) its surface portions adjacent to its outer edge extending substantially in said discharging direction and parallel to the corresponding surface portions of the other guide plates, and (b) its surface portions adjacent to its inner edge extending substantially in the direction of gas flow that has issued from the mouthpiece and is meeting its inner edge, the last mentioned surface portions of the plurality of guide plates being at angles to said extended axis which decrease progressively from the guide plate closest to the mouthpiece to the guide plate farthest from the mouthpiece.

2. The gas deflector of claim 1 wherein a rearmost one of said guide plates is mounted at a location intermediate the front and rear ends of the mouthpiece and spaced to said side of said extended axis from said edge thereof that defines a mouth for the mouthpiece, and wherein a front one of said guide plates is spaced a substantial distance forwardly from the front end of the mouthpiece.

3. Gas deflector means whereby powder gases issuing forwardly from the barrel of an aircraft-carried gun are deflected to a discharging direction wherein they flow to one side of the forwardly extended axis of the gun barrel and away from parts of the aircraft that would be adversely affected by such gases, said gas deflector means comprising:

A. a housing;

B. a mouthpiece in the form of a length of pipe having an inside diameter at least as large as that of the gun barrel and having front and rear ends, said mouthpiece (1) being mounted (a) concentrically to said extended axis and (b) with its rear end adjacent to the front end of the barrel, and (2) having an edge which defines a mouth for the mouthpiece that opens obliquely forwardly and to said side of said extended axis and which (a) is contained in a plane lying at an acute angle to said extended axis, (b) extends entirely across the mouthpiece and (c) extends along the mouthpiece (i) from a substantially pointed front end thereof (ii) to near the rear end of the mouthpiece, but in forwardly spaced relation thereto, to define a short rear portion of the mouthpiece that is tubular and uninterrupted around its periphery;

C. a plurality of guide plates mounted on the housing at the exterior of said mouthpiece, (1) each said guide plate having substantially opposite inner and outer edges that extend substantially transversely to said extended axis, said inner edge of each guide plate being proximal to said extended axis, (2) said guide plates (a) having their inner edges spaced to said side of said extended axis at substantially uniform distances therefrom and (b) being spaced apart in the direction along said axis at substantially uniform distances to cooperate in defining gas outlet slots, and (3) each guide plate being so curved between its inner and outer edges as to have (a) its surface portions adjacent to its outer edge extending substantially in said discharging direction and parallel to the corresponding surface portions of the other guide plates, and (b) its surface portions adjacent to its inner edge extending substantially in the direction of flow of gas that has issued from the mouthpiece and is meeting its inner edge, the last mentioned surface portions of the plurality of guide plates being at angles to said extended axis which decrease progressively from the guide plate closest to the mouthpiece to the guide plate farthest from the mouthpiece.

4. The gas deflector of claim 3 wherein said acute angle is at least 10° but not greater than 20°.

5. The gas deflector of claim 3 wherein said mouthpiece is connected to the gun barrel to be constrained to axial motion therewith relative to the aircraft structure.

6. The gas deflector of claim 3 wherein said mouthpiece and at least certain of said guide plates are connected to the gun barrel to be constrained to move axially with it relative to the aircraft.

* * * * *